US011835977B2

(12) United States Patent
Mii

(10) Patent No.: US 11,835,977 B2
(45) Date of Patent: Dec. 5, 2023

(54) CONSTANT VOLTAGE CIRCUIT FOR IMPROVEMENT OF LOAD TRANSIENT RESPONSE WITH STABLE OPERATION IN HIGH FREQUENCY, AND ELECTRONIC DEVICE THEREWITH

(71) Applicant: Nisshinbo Micro Devices Inc., Tokyo (JP)

(72) Inventor: Kenji Mii, Ibaraki (JP)

(73) Assignee: Nisshinbo Micro Devices Inc., Tokyo (JP)

( * ) Notice: Subject to any disclaimer, the term of this patent is extended or adjusted under 35 U.S.C. 154(b) by 286 days.

(21) Appl. No.: 17/602,053

(22) PCT Filed: Jun. 12, 2019

(86) PCT No.: PCT/JP2019/023337
§ 371 (c)(1),
(2) Date: Oct. 7, 2021

(87) PCT Pub. No.: WO2020/250349
PCT Pub. Date: Dec. 17, 2020

(65) Prior Publication Data

US 2022/0197320 A1 Jun. 23, 2022

(51) Int. Cl.
*G05F 1/40* (2006.01)
*G05F 1/46* (2006.01)
(Continued)

(52) U.S. Cl.
CPC ..... *G05F 1/40* (2013.01); *G05F 1/461* (2013.01); *G05F 3/04* (2013.01); *G05F 3/262* (2013.01)

(58) Field of Classification Search
CPC ... G05F 1/40; G05F 1/461; G05F 3/04; G05F 3/362
See application file for complete search history.

(56) References Cited

U.S. PATENT DOCUMENTS

2011/0122664 A1* 5/2011 Yabuzaki ..... H02M 1/32 363/53
2013/0294125 A1* 11/2013 Chen ..... H02M 1/4225 363/89
(Continued)

FOREIGN PATENT DOCUMENTS

CN 104679088 A 6/2015
CN 104714586 A 6/2015
(Continued)

OTHER PUBLICATIONS

International Search Report dated Aug. 27, 2019 for PCT/JP2019/023337.
(Continued)

*Primary Examiner* — Sisay G Tiku
(74) *Attorney, Agent, or Firm* — Paul Teng

(57) ABSTRACT

A constant voltage circuit amplifies an error between a reference voltage and an output voltage by an operational amplifier, and controls a load current based on the amplified voltage so that the output voltage becomes a constant voltage. The constant voltage circuit includes voltage detector means that detects only AC components of the output voltage limited to a predetermined band and outputs a detected voltage; voltage amplifier means that amplifies AC components of the detected voltage and outputs an amplified voltage; judgment means that outputs a judgment signal indicating whether or not the amplified voltage equal to or larger than a predetermined threshold; and controller means configured to increase a current value of the constant current source included in the operational amplifier, based on the judgment signal, thereby temporarily increasing a current consumption of the operational amplifier.

4 Claims, 8 Drawing Sheets

(51) Int. Cl.
*G05F 3/04* (2006.01)
*G05F 3/26* (2006.01)

(56) References Cited

U.S. PATENT DOCUMENTS

| | | | | |
|---|---|---|---|---|
| 2015/0171731 | A1 | 6/2015 | Tomioka et al. | |
| 2016/0342171 | A1* | 11/2016 | Tomioka | G05F 3/262 |
| 2018/0292854 | A1* | 10/2018 | Kurozo | G05F 1/575 |
| 2019/0146532 | A1* | 5/2019 | Ballarin | G05F 1/462 323/283 |

FOREIGN PATENT DOCUMENTS

| | | | |
|---|---|---|---|
| CN | 108491020 | A | 9/2018 |
| CN | 108710399 | A | 10/2018 |
| JP | 2012-155395 | A | 8/2012 |
| JP | 2014-6794 | A | 1/2014 |
| JP | 2015-118452 | A | 6/2015 |
| JP | 2015-158732 | A | 9/2015 |

OTHER PUBLICATIONS

International Preliminary Report on Patentability (IPRP), dated Dec. 23, 2021 and received in connection with PCT/JP2019/023337.

Jul. 5, 2022 Chinese official action (and English translation thereof) in connection with Chinese Patent Application No. 2019800958505.

* cited by examiner

Tout
Iload
Vout
LOAD
6
20
5
M1
S
D
R10
R11
8
Vfb
M2
1
M4
M5
M3
Vref
SW1
14
15
Vdd
7
2
16
19
18B
13B
4B
4
18A
4A
13
M6
Vbias1
M7
M10
M11
3
17
12
Tin
Vbias
M8
M9
Vd

CONSTANT VOLTAGE CIRCUIT FOR IMPROVEMENT OF LOAD TRANSIENT RESPONSE WITH STABLE OPERATION IN HIGH FREQUENCY, AND ELECTRONIC DEVICE THEREWITH

TECHNICAL FIELD

The present invention relates to a constant voltage circuit that generates a predetermined voltage based on a power supply voltage, and to an electronic device equipped with the constant voltage circuit.

BACKGROUND ART

In an operational amplifier and a constant voltage circuit using the operational amplifier circuit, when the current consumption is reduced, the operating frequency becomes low and it becomes difficult to secure a response performance to the load transient fluctuation connected to the constant voltage circuit. As a means to solve this problem, a method (hereinafter referred to as a conventional example) has been known which improves the response performance by inputting a voltage linked to the output voltage to the differentiation circuit, amplifying the output voltage of a differentiation circuit, superimposing the current corresponding to the amplified voltage on a consumption current of the operational amplifier, and increasing the current to change the operation frequency into a wide band (See, for example, Patent document 1: Japanese patent laid-open publication No. JP2015-158732A).

SUMMARY OF THE INVENTION

Problem to be Solved by the Invention

However, in the conventional method of amplifying the input signal of the differentiation circuit, the use of an amplification stage causes amplification of minute output voltage signals in the high-frequency band, resulting in problems such as unstable output of the operational amplifier and unintentional increase in the current consumption. In addition, when the resistance component of the differentiation circuit is increased to widen the operating frequency band to improve the transient response performance, the resistance element area becomes larger.

The purpose of the present invention is to solve the above problems, and to provide a constant voltage circuit which can improve the load transient response characteristics while maintaining the stable operation of the constant voltage circuit in high frequency, and an electronic device equipped with the constant voltage circuit.

Means for Solving the Problems

According to one aspect of the present invention, there is provided a constant voltage circuit including an operational amplifier including a constant current source. The operational amplifier amplifies an error between a predetermined reference voltage and an output voltage, and the constant voltage circuit controls a load current based on an amplified voltage so that the output voltage is controlled to be a predetermined constant voltage. The constant voltage circuit includes voltage detector means, voltage amplifier means, judgment means, and controller means. The voltage detector means detects only AC components of the output voltage limited to a predetermined band, and outputs a detected voltage, and the voltage amplifier means amplifies AC components of the detected voltage and outputs an amplified voltage. The judgment means outputs a judgment signal indicating whether or not the amplified voltage is equal to or larger than a predetermined threshold, based on the amplified voltage. The controller means is configured to increase a current value of the constant current source of the operational amplifier based on the judgment signal, thereby temporarily increasing a current consumption of the operational amplifier.

Effect of the Invention

According to the constant voltage circuit of the present invention, by easily realizing detection and amplification of only a part of the frequency band superimposed on the output voltage, it is possible to improve the load transient response characteristics while maintaining the stable operation of the constant voltage circuit in high frequency.

BEST MODE FOR IMPLEMENTING THE INVENTION

Embodiments of the present invention are described below with reference to the drawings. The same or similar components are indicated with the same numerical references.

Embodiment 1

Figure 1:
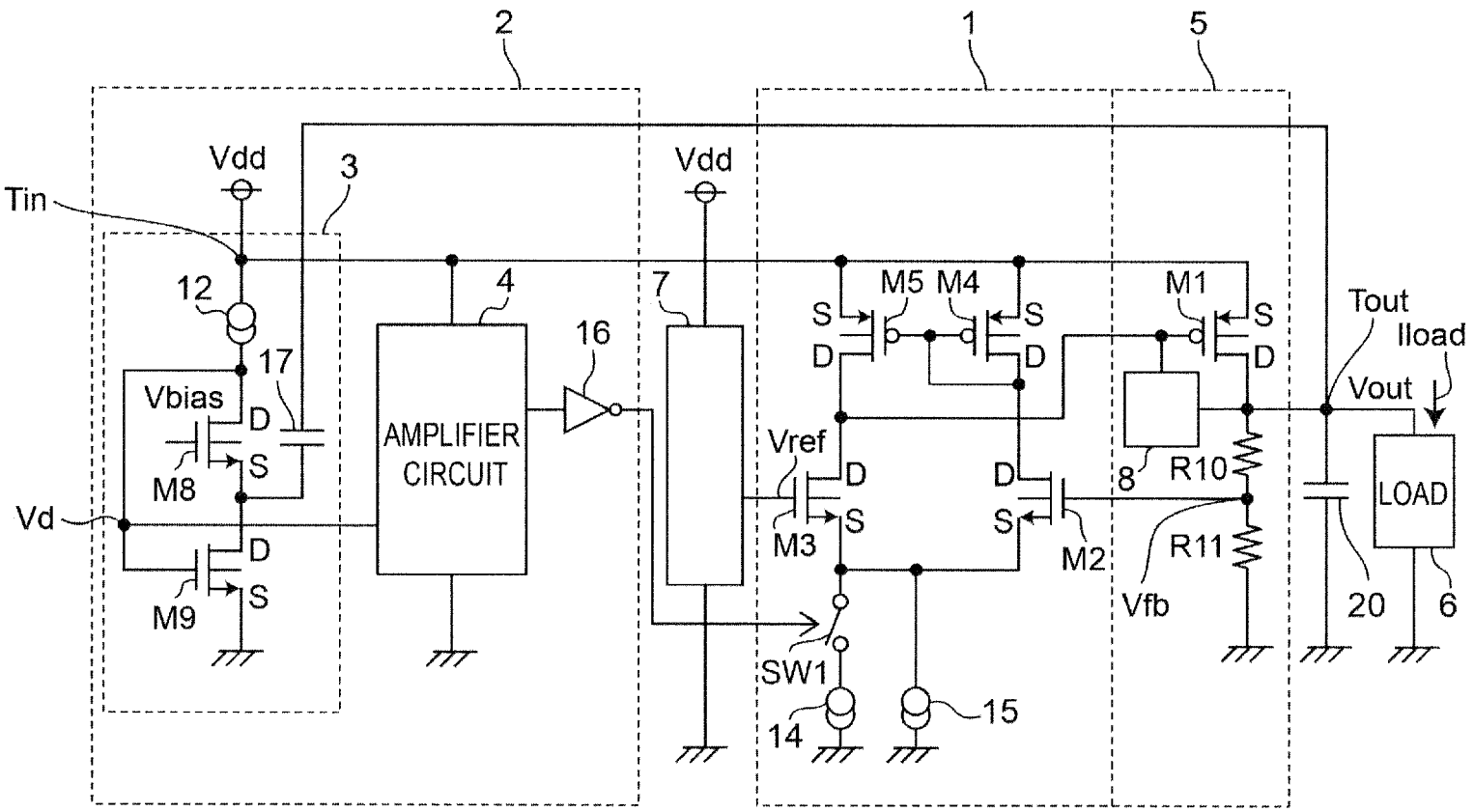
FIG. 1 is a circuit diagram showing an example of configuration of a constant voltage circuit according to Embodiment 1.

FIG. 1 is a circuit diagram showing an example of configuration of a constant voltage circuit according to Embodiment 1.

Referring to FIG. 1, the constant voltage circuit according to Embodiment 1 amplifies a reference voltage Vref generated from a power supply voltage Vdd by the reference voltage generator circuit 7, by the operational amplifier 1 including the constant current sources 14 and 15, and controls a load current Iload by a current control circuit 5 based on the amplified voltage, to control the output voltage Vout to be a predetermined constant voltage. A load 6 is connected between an output terminal Tout which outputs the output voltage Vout, and the ground voltage (GND). In this case, the load 6 is, for example, an electronic device having a predetermined function that receives the power supply voltage Vdd from the constant voltage circuit. The load 6 is specifically an electronic device for automobiles that receives a power supply voltage from the constant voltage circuit, or an image forming device such as a copier or printer that receives a power supply from the constant voltage circuit. Each of these electronic devices or equipment may be also configured to have a constant voltage circuit.

The constant voltage circuit of FIG. 1 is configured to include an operational amplifier 1, a transient characteristics improvement circuit 2, a current control circuit 5, and a smoothing capacitor 20. In this case, the transient characteristics improvement circuit 2 is equipped with a voltage detector circuit 3 and an amplifier circuit 4, which is a voltage amplifying means, to improve the transient characteristics by preventing overshoot or undershoot, etc. In addition, the reference voltage generator circuit 7 generates a predetermined reference voltage Vref from the power supply voltage Vdd.

The current control circuit 5 includes the following:

(1) resistors R10 and R11 for output voltage detection, which divide the output voltage Vout to generate and output a divided voltage Vfb;

(2) a driver transistor M1 of a P-channel MOS transistor (hereinafter referred to as PMOS transistor), which controls the current to output the output voltage Vout according to the signal inputted to the gate; and (3) a phase compensation circuit 8, which is connected between one end of resistor R10 and the gate of transistor M1, and is a series circuit of a resistor and a capacitor.

The operational amplifier 1 configures an error amplifier circuit that controls the operation of the driver transistor M1 so that the divided voltage Vfb becomes the reference voltage Vref. The transient characteristics improvement circuit 2 detects and amplifies the output voltage Vout to control the constant current source 14. In this case, the operational amplifier 1 includes PMOS transistors M4 and M5, which configure a current mirror circuit; N-channel MOS transistors (hereinafter referred to as NMOS transistors) M2 and M3; a constant current source 15 that supplies a predetermined constant current; a constant current source 14 that supplies a predetermined constant current; and a switch SW1.

A driver transistor M1 is connected between an input terminal Tin connected to a power supply voltage Vdd and an output terminal Tout, and a series circuit of resistors R10 and R11 is connected between the output terminal Tout and a ground voltage (GND). In this case, the divided voltage Vfb is outputted from the connection point between resistors R10 and R11. The reference voltage Vref is inputted from the reference voltage generator circuit 7 to the gate of the NMOS transistor M3, which configures an inverting input terminal of the operational amplifier 1. The divided voltage Vfb is inputted to the gate of the NMOS transistor M2, which configures a non-inverting input terminal of the operational amplifier 1. The NMOS transistors M2 and M3 configures a differential pair, and the PMOS transistors M5 and M4 form a current mirror circuit and configure the load of the differential pair.

In the PMOS transistors M4 and M5, each of the sources thereof is connected to the input voltage Vdd, and the gates thereof are connected to each other, and its connection point is connected to the drain of the PMOS transistor M4. In addition, the drain of the PMOS transistor M4 is connected to the drain of the NMOS transistor M2, and the drain of the PMOS transistor M5 is connected to the drain of the NMOS transistor M3. The sources of the NMOS transistors M2 and M3 are connected to each other. Further, between the connection point and the ground voltage (GND), a series circuit of the constant current source 14 and a switch SW1, and the constant current source 15 are connected in parallel to each other. It is noted that the phase compensation circuit 8 is connected between the output terminal Vout and the gate of MOS transistor M1.

The operational amplifier 1 configured as described above amplifies the voltage difference between the reference voltage Vref and the divided voltage Vfb, outputs an amplified voltage difference to the gate of the driver transistor M1, and controls the output current outputted from the driver transistor M1 so that the output voltage Vout becomes a predetermined voltage.

The transient characteristics improvement circuit 2 includes a voltage detector circuit 3, an amplifier circuit 4, and an inverter 16 that configures a judgment circuit. The voltage detector circuit 3 is equipped with NMOS transistors M8 and M9, a constant current source 12 that supplies a predetermined constant current, and a capacitor 17 that detects fluctuations in the output voltage Vout. One end of the constant current source 12 is connected to the power supply voltage Vdd, and another end of the constant current source 12 is connected to the drain of the NMOS transistor M8 and the gate of the NMOS transistor M9. A capacitor 17 is connected to the source of the NMOS transistor M8 and to the drain of the source-grounded NMOS transistor M9, and the drain of the NMOS transistor M8 is connected to the gate of the NMOS transistor M9. In addition, it is noted that a predetermined bias voltage is applied to the gate of the NMOS transistor M8. The gate of NMOS transistor M9 is connected to the input terminal of amplifier circuit 4.

Next, the operation of the transient characteristics improvement circuit 2 will be explained.

The voltage detector circuit 3, which is configured by including the NMOS transistors M8 and M9 and the constant current source 12, detects only high frequency AC components of the output voltage Vout, amplifies a signal in phase with the detection waveform, and outputs the amplified signal as the detected voltage Vd. After the AC components of the detected voltage Vd from the voltage detector circuit 3 is amplified by the amplifier circuit 4, the inverter 16, which is a judgment circuit, makes a threshold judgment on the amplified AC components. In other words, when the voltage of the input AC components becomes less than the predetermined threshold voltage, the inverter 16 outputs an H-level judgment signal to the control terminal of the switch SW1 to turn on the switch SW1. On the other hand, when the voltage of the input AC components becomes equal to or higher than the predetermined threshold voltage, an L-level judgment signal is outputted to the control terminal of switch SW1 to turn off switch SW1. As a result, the inverter 16 controls turning on/off the constant current source 14 that supplies the predetermined constant current for the operational amplifier 1. It is noted that, for example, the switch SW1 is configured by a MOS transistor.

By connecting the drain of NMOS transistor M8 to the gate of NMOS transistor M9, the output resistance of the drain of NMOS transistor M9 is reduced. The capacitor 17 that detects output voltage fluctuations is connected to the source of the NMOS transistor M8. This makes it possible to operate for AC components according to the filter frequency determined by the capacitor 17 and the output resistance, which is configured by the output resistances of the source node of NMOS transistor M8 and the drain node of NMOS transistor M9 connected in parallel, and also to configure the frequency range selective voltage detector circuit 3 to attenuate high frequency components according to the MOS characteristics of the NMOS transistor M9 in accordance with the current value of the constant current source 12.

According to the embodiment 1 configured as described above, the controller means is provided to temporarily increase the current consumption of the operational amplifier by increasing the current value of the constant current source 14 of the operational amplifier 1 (turning on the switch SW1) based on the judgment signal. This allows the response characteristics of the constant voltage circuit to operate stably with high speed and high precision. In addition, by using the frequency range selective voltage detector circuit 3 (including band-pass filter), the response of the high frequency band, which could not be realized in the low consumption state, becomes possible, and the risk of oscillation can be suppressed by attenuating the gain in the high frequency band when the switch SW1 is turned on. This enables response for high-frequency components even with reduced current consumption, while reducing the chip area as compared with the conventional technology because it does not require differentiation circuits, etc., including silicon resistance elements. Furthermore, by using the frequency range selective voltage detector circuit 3 (including band-pass filter) to remove disturbance noise in a band higher than the passband, the circuit with high robustness can be realized. The same effect can be achieved by using a PMOS transistor to configure the voltage detector circuit 3.

Figure 5:
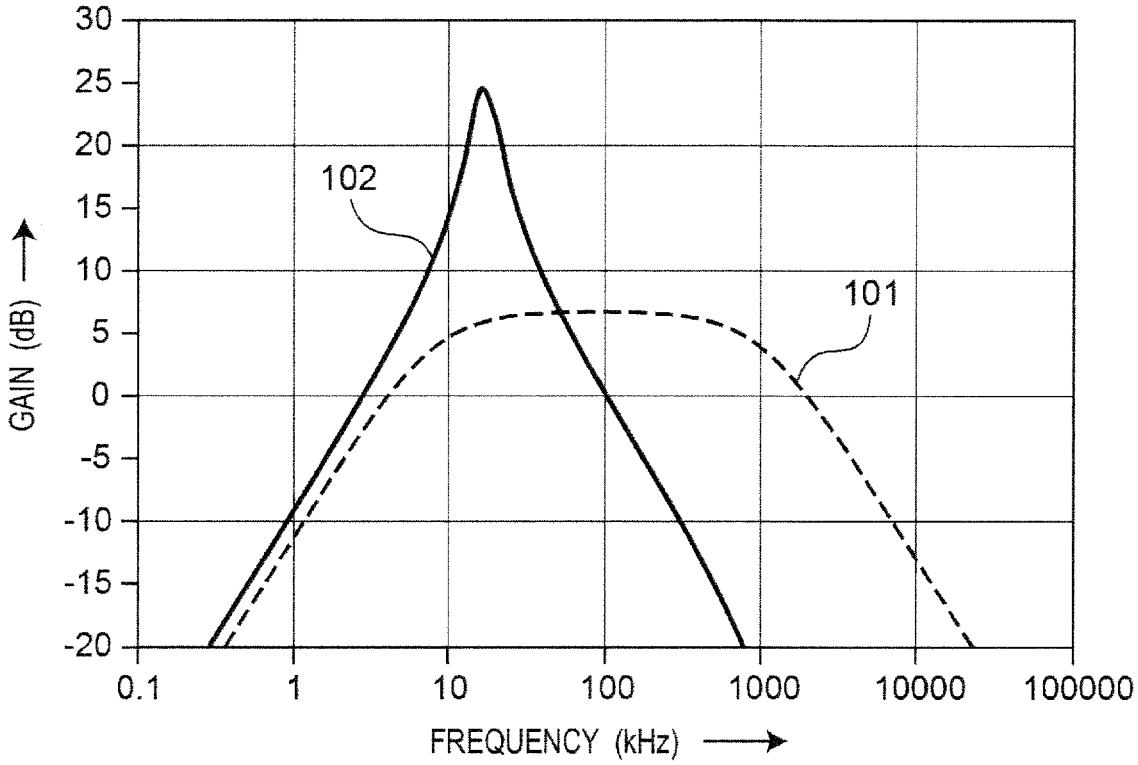
FIG. 5 is a graph showing frequency characteristics of a detector circuit (including an amplifier circuit) according to a conventional example and Embodiment 1.

FIG. 5 is a graph showing frequency characteristics of the detector circuits (including the amplifier circuit) according to the conventional example and Embodiment 1. In FIG. 5, 101 denotes frequency characteristics of the differentiation circuit and amplifier circuit according to the conventional example, and 102 denotes frequency characteristics of the frequency range selective voltage detector circuit 3 and the amplifier circuit 4 according to Embodiment 1. As can be seen from FIG. 5, it is operable for AC components according to the filter frequency, and the high frequency components can be attenuated in accordance with the MOS characteristics of NMOS transistor M9 according to the current value of constant current source 12. Therefore, even with reduced current consumption, the output voltage of the operational amplifier can be stabilized by enabling a response to the high frequency component specified by the frequency range selective voltage detector circuit 3, while the chip area can be reduced as compared with the conventional technology because the differentiation circuit, etc., of the conventional example is not required.

Figure 6A:
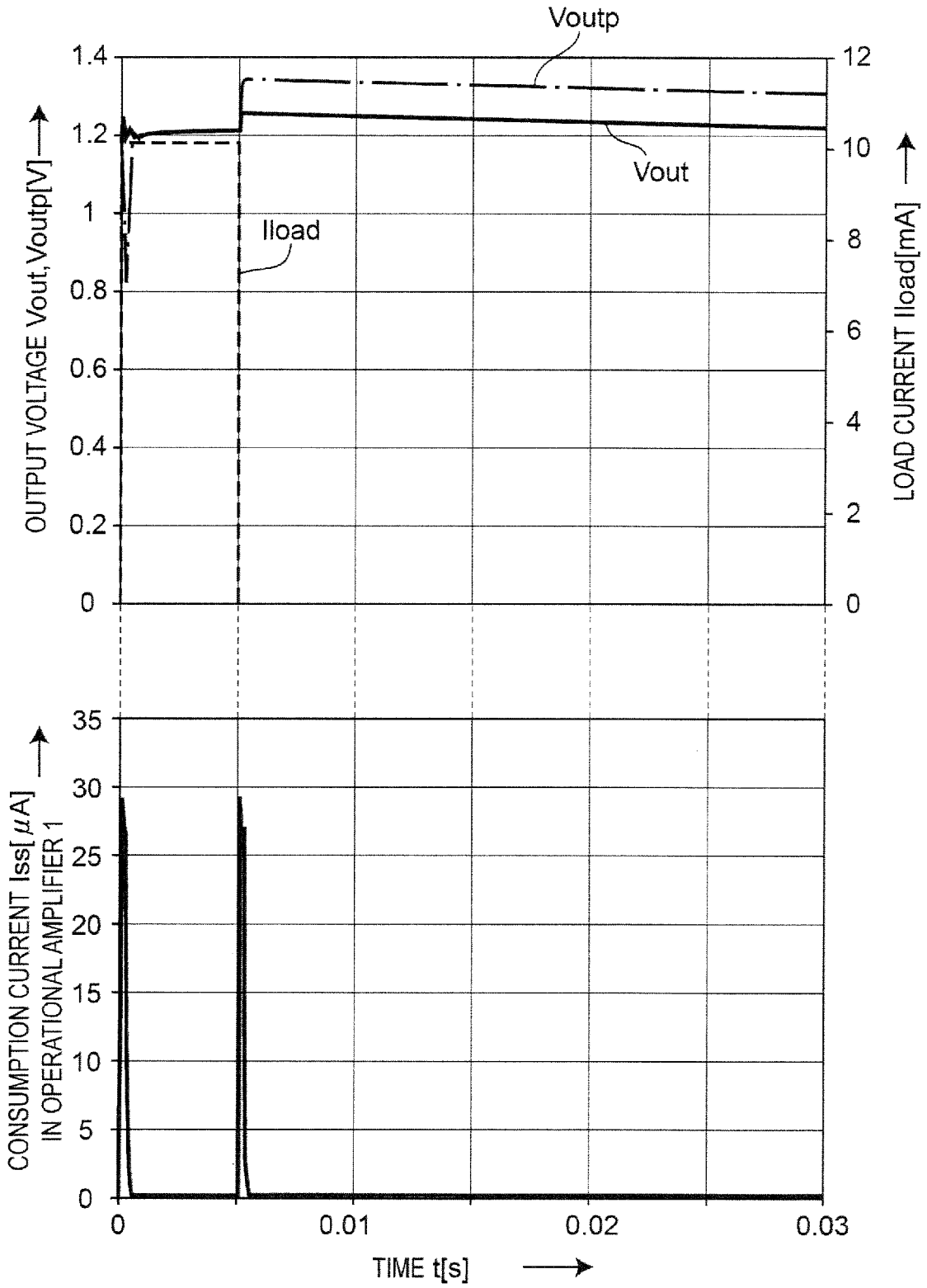
FIG. 6A is a waveform chart showing an output voltage Vout of the constant voltage circuit according to Embodiment 1, a load current Iload thereof and a consumption current Iss of an operational amplifier 1, and an output voltage Voutp of the constant voltage circuit according to the conventional example.
Figure 6B:
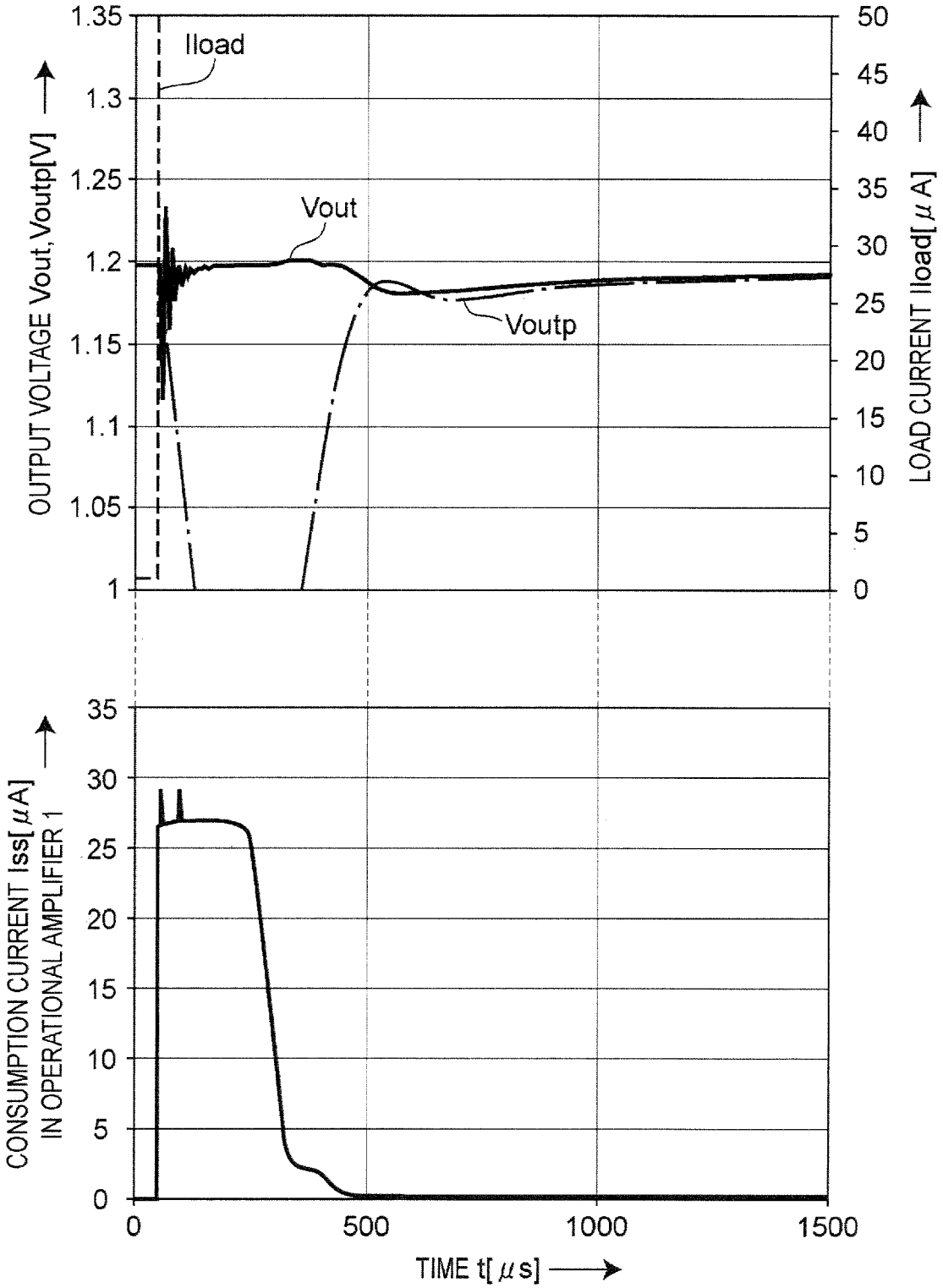
FIG. 6B is an enlarged chart of both axes of FIG. 6A.
Figure 6C:
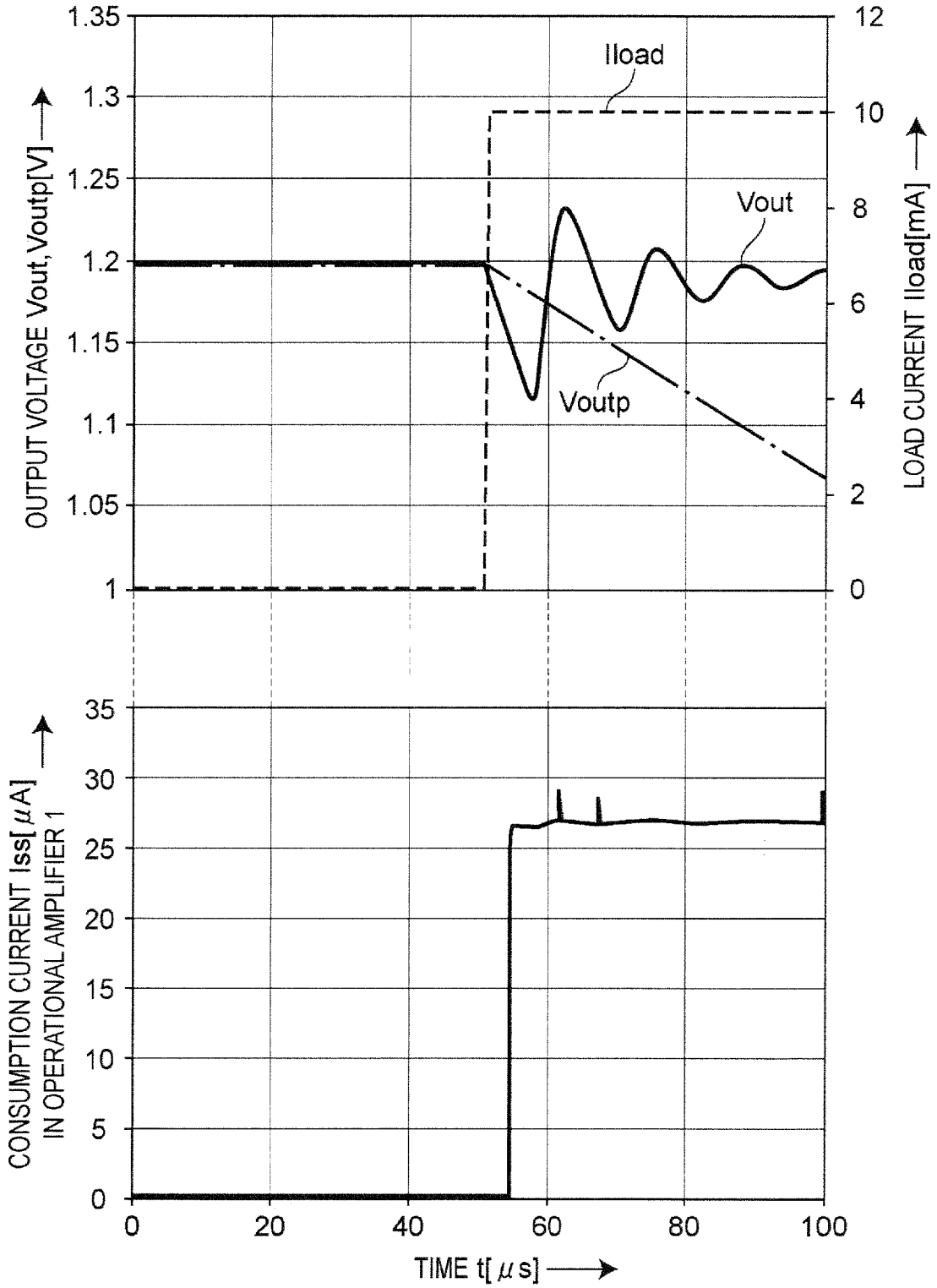
FIG. 6C is an enlarged chart of time axis of FIG. 6A.

FIG. 6A is a waveform chart showing time waveforms of the output voltage Vout of the constant voltage circuit according to Embodiment 1, the load current Iload thereof, and the consumption current Iss of the operational amplifier 1, and the output voltage Voutp of the constant voltage circuit according to the conventional example (without the transient characteristics improvement circuit 2). FIG. 6B is an enlarged chart of both axes of FIG. 6A, and FIG. 6C is an enlarged chart of the time axis of FIG. 6A. As can be seen from FIG. 5 and FIGS. 6A to 6C, the transient response time can be reduced as compared with the case where the present invention is not used. In addition, by attenuating signals in the band not intended for amplification while maintaining the conventional characteristic of amplifying high-frequency components at the time of output fluctuation, both high-speed response and stable operation can be achieved.

Embodiment 2

Figure 2:
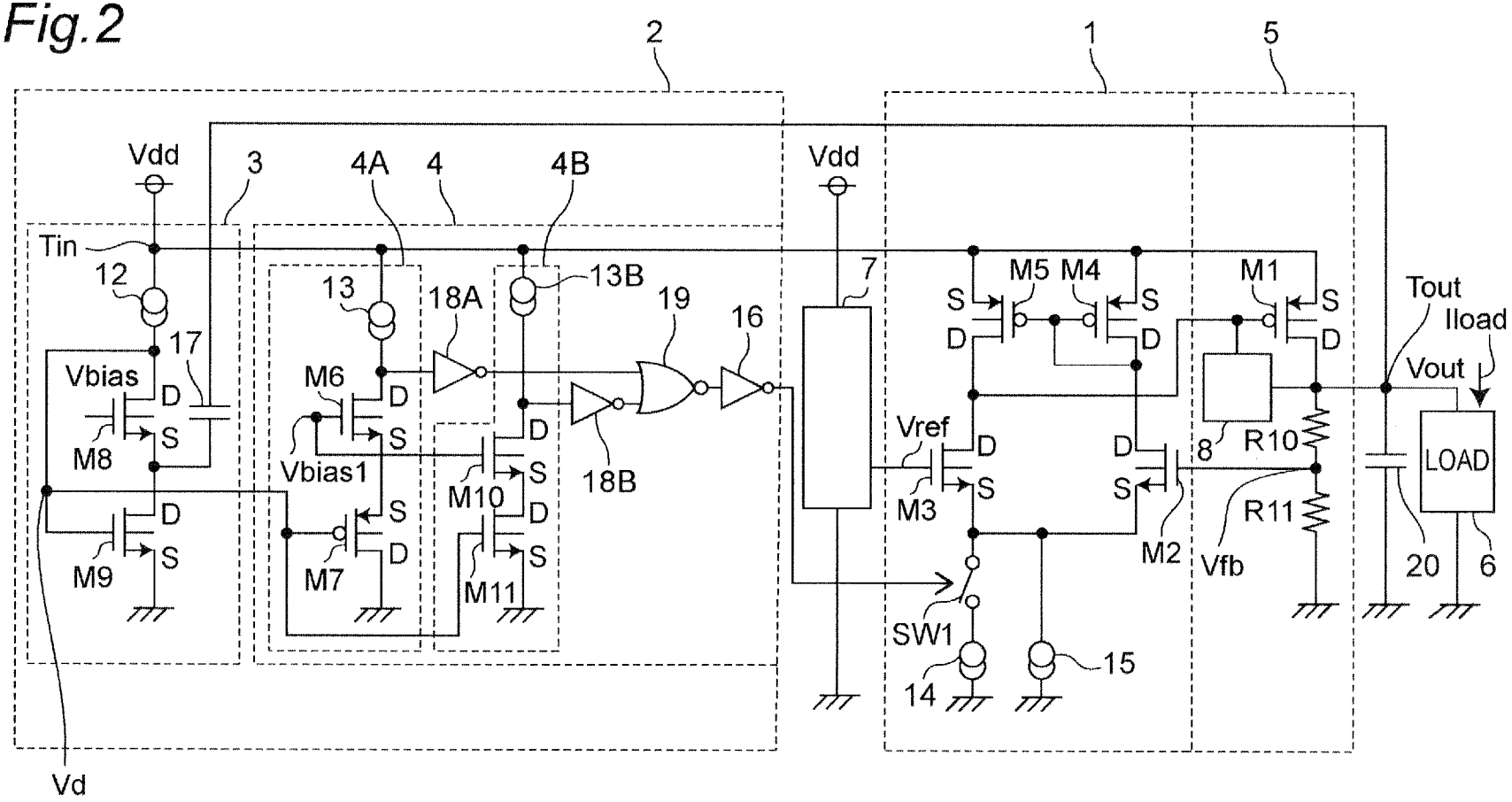
FIG. 2 is a circuit diagram showing an example of configuration of a constant voltage circuit according to Embodiment 2.

FIG. 2 is a circuit diagram of an example of configuration of a constant voltage circuit according to Embodiment 2. The constant voltage circuit according to Embodiment 2 is characterized by showing a specific configuration of the amplifier circuit 4 in FIG. 2. The differences are described in detail below.

Referring to FIG. 2, the amplifier circuit 4 is configured to include amplifiers 4A and 4B, inverters 16, 18A and 18B, and an NOR gate 19. The amplifier 4A is configured to include a constant current source 13, an NMOS transistor M6, and a PMOS transistor M7, which are connected in series to each other. The following is a detailed description of the differences from Embodiment 1.

The gate of the NMOS transistor M9 of the voltage detector circuit 3 is connected to the gate of the PMOS transistor M7 to form a source follower circuit, and the detected voltage Vd from the voltage detector circuit 3 is applied to the gate of the PMOS transistor M7. One end of the constant current source 13 is connected to the power supply voltage Vdd, and another end of the constant current source 13 is connected to the drain of the NMOS transistor M6. A predetermined bias voltage Vbias1 is applied to the gate of the NMOS transistor M6. The source of the NMOS transistor M6 is connected to the source of the drain-grounded PMOS transistor M7, and the drain of the NMOS transistor M6 is connected to the first input terminal of the NOR gate 19 through the inverter 18A, which is a judgment circuit.

The amplifier 4B is configured to include a constant current source 13B and NMOS transistors M10 and M11, which are connected in series to each other. One end of the constant current source 13B is connected to the power supply voltage Vdd, and another end of the constant current source 13B is connected to the drain of the NMOS transistor M10 and the second input terminal of the NOR gate 19 via the inverter 18B. A predetermined bias voltage Vbias1 is applied to the gate of NMOS transistor M10. The source of the NMOS transistor M10 is connected to the drain of the source-grounded NMOS transistor M11. The detected voltage Vd from the voltage detector circuit 3 is applied to the gate of the NMOS transistor M11.

In addition, the output signal from the NOR gate 19 is inputted to the inverter 16, which is a judgment circuit.

In order to amplify the undershoot in the detected voltage Vd, the amplifier 4A of the amplifier circuit 4 configured as described above connects the NMOS transistor M6 that configures the gate-grounded amplifier circuit operating at a predetermined operating point to the PMOS transistor M7 for amplification, and amplifies and outputs the detected voltage Vd through the NMOS transistor M6. In the amplifier 4B, in order to amplify the overshoot in the detected voltage Vd, the NMOS transistor M10, which configures the gate-grounded amplifier circuit operating at a predetermined operating point, is connected to the NMOS transistor M11 for amplification, and amplifies and outputs the detected voltage Vd via the NMOS transistor M11.

In the constant voltage circuit configured as described above, in addition to the effects of Embodiment 1, the undershoot and the overshoot in the detected voltage Vd can be prevented, and both of the high-speed response and the stable operation with high accuracy can be achieved.

Embodiment 3

Figure 3:
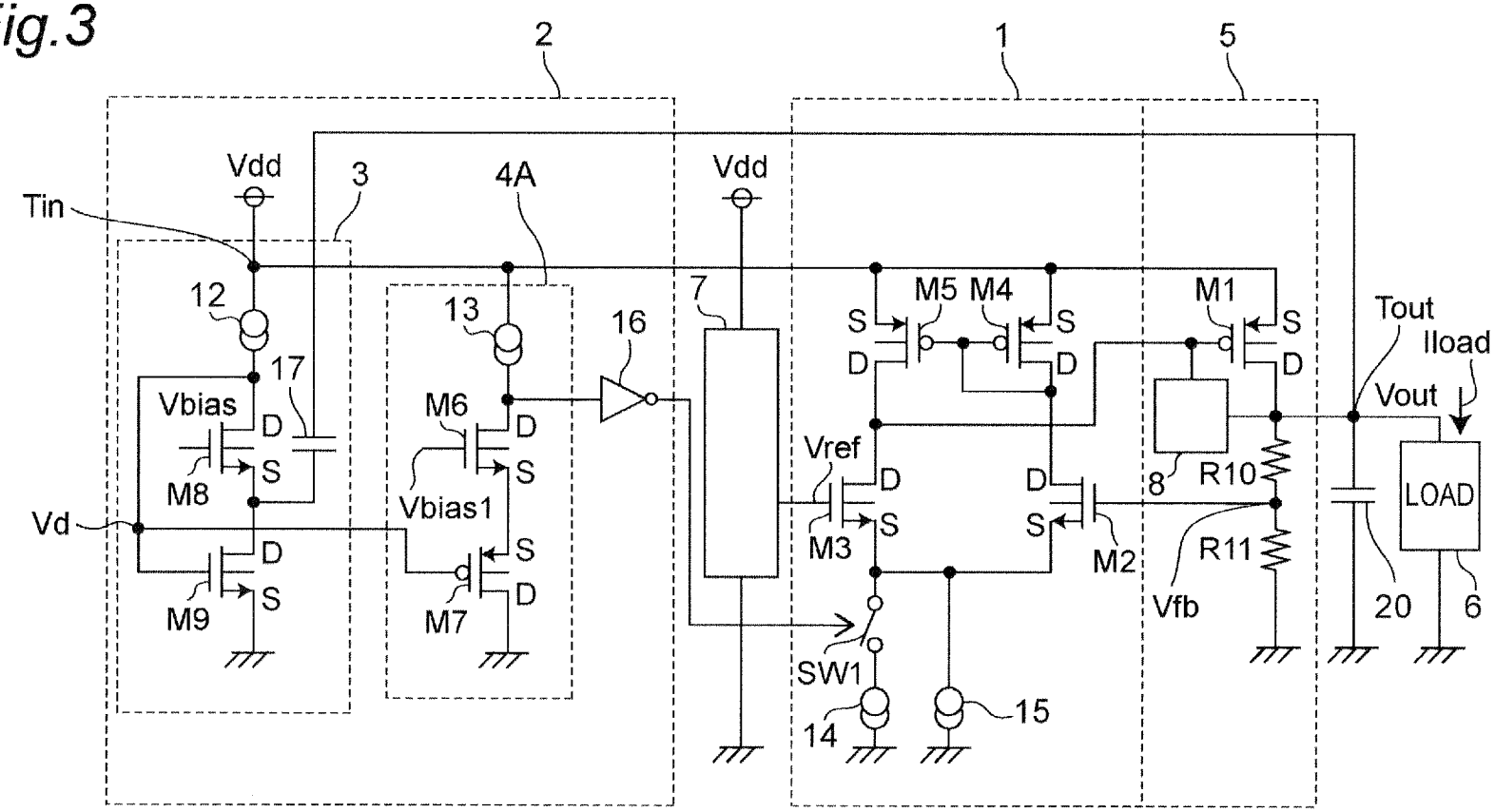
FIG. 3 is a circuit diagram showing an example of configuration of a constant voltage circuit according to Embodiment 3.

FIG. 3 is a circuit diagram showing an example of configuration of a constant voltage circuit configuration according to Embodiment 3. The constant voltage circuit according to Embodiment 3 is characterized in that the amplifier circuit 4 of FIG. 2 is configured to include only the amplifier 4A according to Embodiment 2.

In the constant voltage circuit configured as described above, in addition to the effects of Embodiment 1, the undershoot in the detected voltage Vd can be prevented as described above in Embodiment 2, and both of the fast response and the stable operation can be achieved with higher accuracy.

Embodiment 4

Figure 4:
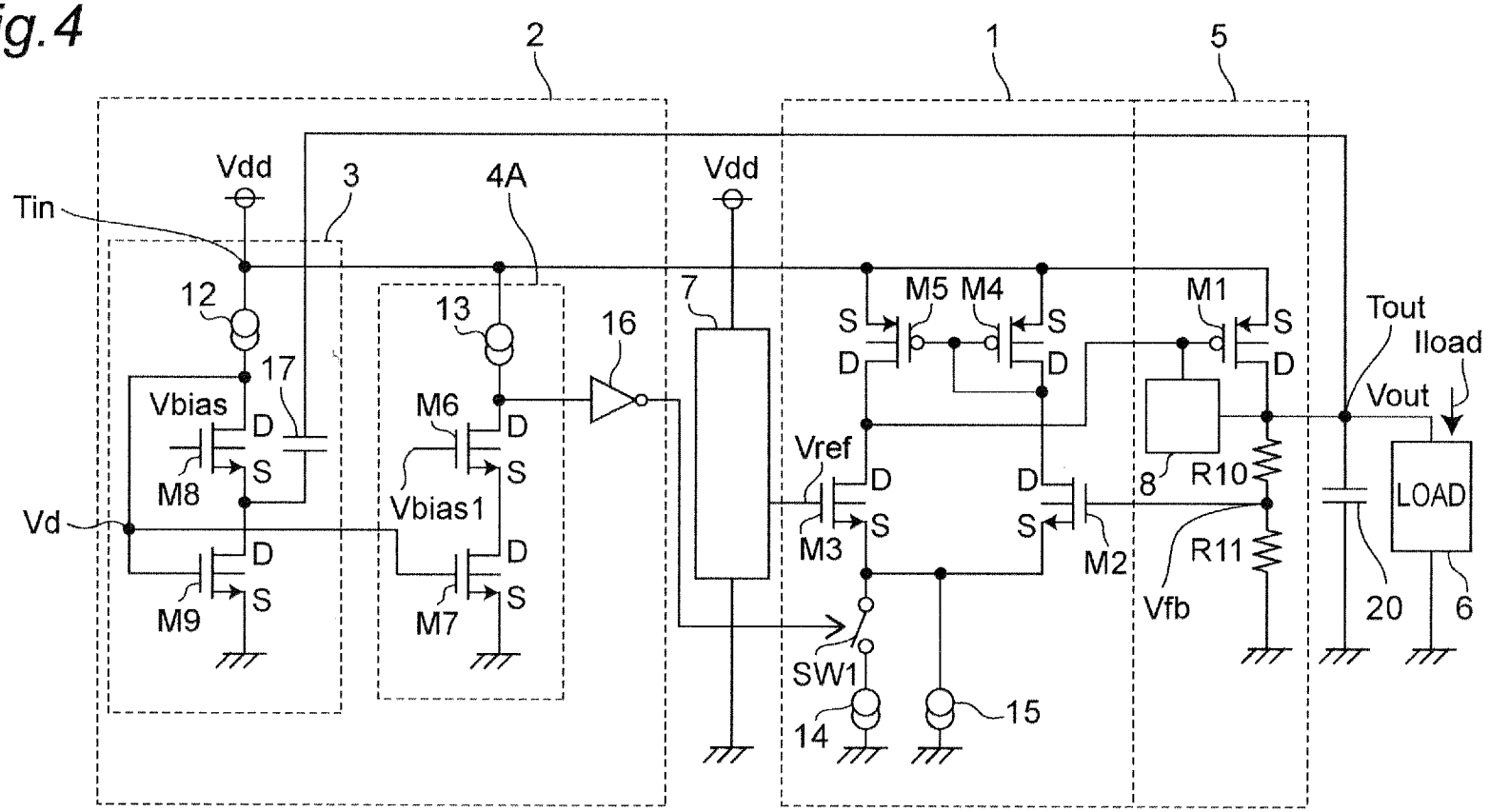
FIG. 4 is a circuit diagram showing an example of configuration of a constant voltage circuit according to Embodiment 4.

FIG. 4 is a circuit diagram showing an example of configuration of a constant voltage circuit according to Embodiment 4. The constant voltage circuit according to Embodiment 4 is characterized in that the amplifier circuit 4 of FIG. 2 is configured to include only the amplifier 4B according to Embodiment 2.

In the constant voltage circuit configured as described above, in addition to the effects of Embodiment 3, the overshoot in the detected voltage Vd can be prevented as described above in Embodiment 2, and both of the fast response and the stable operation can be achieved with higher accuracy.

Modified Embodiment

The above-mentioned Embodiments 1 to 4 disclose the constant voltage circuits. However, when the load 6 is an electronic device, the constant voltage circuit may be built into the electronic device.

Comparison with Patent Document 1

Patent Document 1 discloses a constant voltage circuit with a differentiator circuit for the purpose of speeding up the response time to rapid and sudden changes in load current. The feature of this circuit is that the output voltage of the differentiation circuit is amplified by the amplifier circuit only when the output voltage fluctuates rapidly, and the current corresponding to the amplified output voltage of the differentiation circuit is superimposed on the intermediate node of the operational amplifier.

However, the invention of Patent document 1 does not solve the problems of amplification even for minute output voltage signals in the high-frequency band, causing the output of the operational amplifier to become unstable and increasing the current consumption, and the problem of increasing the resistance element area when the resistance component of the differentiation circuit is increased in order to lower the frequency band.

In contrast to this, in the present invention, while it is possible to use the differential waveform of the output voltage at the moment of transient response, the amplification frequency range limit to the output voltage can be easily implemented according to the current value of the constant current source, thus suppressing current amplification for high frequency components in unintended bands. Therefore, the stable operation can be maintained even when small high frequency components are superimposed on the output voltage while maintaining fast transient response characteristics.

The invention claimed is:

1. A constant voltage circuit comprising an operational amplifier including a constant current source, the operational amplifier amplifying an error between a predetermined reference voltage and an output voltage, the constant voltage circuit controlling a load current based on an amplified voltage so that the output voltage is controlled to be a predetermined constant voltage, the constant voltage circuit comprising:

a voltage detector that detects only high frequency of an AC components of the output voltage limited to a predetermined band, and outputs a detected voltage;

a voltage amplifier that amplifies AC components of the detected voltage and outputs the amplified voltage;

a judgment circuit that outputs a judgment signal indicating whether or not the amplified voltage is equal to or larger than a predetermined threshold, based on the amplified voltage; and a controller configured to increase a current value of the constant current source of the operational amplifier based on the judgment signal, thereby temporarily increasing a current consumption of the operational amplifier.

2. The constant voltage circuit as claimed in claim 1, wherein the voltage amplifier includes an amplifier circuit that prevents at least one of overshoot and undershoot of the AC components of the detected voltage.

3. An electronic device comprising a constant voltage circuit comprising an operational amplifier including a constant current source, the operational amplifier amplifying an error between a predetermined reference voltage and an output voltage, the constant voltage circuit controlling a load current based on an amplified voltage so that the output voltage is controlled to be a predetermined constant voltage, wherein the constant voltage circuit comprises: a voltage detector that detects only high frequency of an AC components of the output voltage limited to a predetermined band, and outputs a detected voltage; a voltage amplifier that amplifies AC components of the detected voltage and outputs the amplified voltage; a judgment circuit that outputs a judgment signal indicating whether or not the amplified voltage is equal to or larger than a predetermined threshold, based on the amplified voltage; and a controller configured to increase a current value of the constant current source of the operational amplifier based on the judgment signal, thereby temporarily increasing a current consumption of the operational amplifier.

4. The electronic device as claimed in claim 3, wherein the voltage amplifier includes an amplifier circuit that prevents at least one of overshoot and undershoot of the AC components of the detected voltage.

* * * * *